US006178889B1

(12) United States Patent
Dindl

(10) Patent No.: US 6,178,889 B1
(45) Date of Patent: Jan. 30, 2001

(54) LOW IMPULSE TELESCOPING CARTRIDGE

(75) Inventor: Frank Dindl, Wharton, NJ (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 09/351,978

(22) Filed: Jul. 12, 1999

Related U.S. Application Data

(60) Provisional application No. 60/109,665, filed on Nov. 9, 1998.

(51) Int. Cl.[7] ..... F42B 3/00; F42B 3/06; F42B 3/02

(52) U.S. Cl. ..... 102/447; 102/444; 102/445; 102/446; 102/430; 102/464; 102/469; 102/470

(58) Field of Search ..... 102/447, 444, 102/445, 446, 430, 464, 469, 470

(56) References Cited

U.S. PATENT DOCUMENTS

| | | | | |
|---|---|---|---|---|
| H114 | * | 8/1986 | Quintavalle | 102/513 |
| 3,744,420 | * | 7/1973 | Barr | 102/38 |
| 4,686,905 | * | 8/1987 | Zsabo | 102/444 |
| 5,359,937 | * | 11/1994 | Dittrich | 102/430 |
| 5,677,505 | * | 10/1997 | Dittrich | 89/14.5 |

* cited by examiner

*Primary Examiner*—Charles T. Jordan
*Assistant Examiner*—Lulit Semunegus
(74) *Attorney, Agent, or Firm*—John F. Moran; Michael C. Sachs

(57) ABSTRACT

A low impulse telescoping cartridge includes a case, a piston, a projectile, and a link. The projectile is seated into the forward portion of the piston. Gas passages permit propellant gases to bleed into the cavity behind the projectile and to accelerate the projectile upon firing. An alternative to using bleed gases is to use a separate propelling charge behind the projectile. The case and piston are assembled and telescopically secured by means of a crimp or other similar feature, to allow relative movement therebetween during chambering and firing. The link may be allowed to move for some portion of the required relative travel between the link and the base of the case. A shoulder on the piston provide a stop through which reaction loads are transmitted to the rear of the barrel during chambering and firing. The piston telescopes over the case during chambering to provide the relative movement between the link and the case base required for weapon function. Upon firing, the expanding propellant gases force the case and piston to telescope open. Reaction loads are applied to the rear of the barrel through the shoulder, and at the same time are applied to a bolt, driving it rearwardly to cycle the weapon. The cartridge can be used in use in automatic weapon systems including but not limited to 40 mm MK19 Grenade Machineguns.

15 Claims, 17 Drawing Sheets

LOW IMPULSE TELESCOPING CARTRIDGE

RELATED APPLICATIONS

This application claims benefit of filing date Nov. 9, 1998 of provisional application 60/109,665, the entire file wrapper contents of (all of) which application(s) are (is) herewith incorporated by reference as though fully set forth herein at length.

BACKGROUND OF THE INVENTION

1. Field of the Invention

The present invention relates in general to the field of ammunition, and it particularly relates to low impulse cartridges. More specifically, the present invention relates to a low impulse telescoping cartridge for use in automatic weapon systems such as the 40 mm MK19 Grenade Machinegun, though the inventive concept is applicable to any caliber of weapon and ammunition.

2. Description of Related Art

An automatic weapon such as the 40 mm MK19 Grenade Machinegun is typically actuated by the direct blowback of the cartridge case against the bolt upon expansion of the propellant gas during the time between cartridge ignition and projectile exit from the barrel. The MK19 Grenade Machinegun is designed to function when firing 40 mm cartridges with a cartridge impulse of approximately 13 to 15 pound-seconds. Reduced cartridge impulses provided by lower mass projectiles and/or reduced chamber pressure will result in reduced energy transferred to the bolt. Consequently, the weapon cyclic rate and reliability will be adversely affected. Exemplary low impulse cartridges that produce much lower impulse levels than required to function the MK19 Grenade Machinegun in the fully automatic mode include blanks, limited range training cartridges, and non-lethal cartridges.

One attempt to achieve reliable weapon function by including a telescoping cartridge case and piston configuration is described in U.S. Pat. No. 5,359,937 to Dittrich. The firearm barrel in Dittrich requires a chamber with an annular step at its forward end or a similar feature for the piston to push against. However, many conventional weapons, including the MK19 Grenade Machinegun do not have such a feature and it would be quite a laborious and expensive undertaking to retrofit the Dittrich design in such conventional weapons.

Therefore, there is a great and still unsatisfied need for a low impulse cartridge which is forced against the rear surface (or breech) of the barrel particularly when the firearm is set in an automatic mode.

SUMMARY OF THE INVENTION

One feature of the present invention is to satisfy this long felt need, and to provide a low impulse cartridge for use in a conventional automatic weapon systems such as the 40 mm MK19 Grenade Machinegun.

Another feature of the present invention is to provide an ammunition configuration that accelerates a bolt to the rear independently of the impulse generated from launching the projectile. This allows for the launching of low velocity and/or low mass projectiles (or payloads such as non-lethal multiple rubber balls, bean bags, foam batons, wood batons, sponge grenades, flash bang projectiles, limited range training projectiles, low cost training projectiles, etc.), and the firing of blank cartridges while functioning the MK19 Grenade Machinegun or other firearms in a fully automatic mode.

A further feature of the present invention is to provide a fully automatic weapon function without requiring changes to the weapon itself, while permitting effective firing of reduced velocity and/or reduced mass projectiles.

These and other features and advantages of the invention are achieved by a low impulse, telescoping cartridge for limited range training projectiles, low cost training cartridges, non-lethal projectiles/payloads, blank cartridges, and other applications.

The cartridge is comprised of a piston, a link, and a case in which a primer is fitted. The cartridge collapses during chambering to allow for the link movement relative to the base of the cartridge case during chambering, and for expanding the case during the weapon powering (or firing) stage of operation.

The cartridge provides the exterior cartridge characteristics required to feed through the weapon and chamber prior to firing. The telescoping cartridge case includes a shoulder or boss which is positioned under the link to provide a cartridge stop against the rear of the barrel, and through which the reaction loads are transmitted to counteract the loads applied to the bolt during rearward acceleration of the bolt.

In the case of the MK19 Grenade Machinegun, the shoulder is designed to allow the link to move rearward for a portion of the travel distance required between the link and the cartridge base. The case telescopes for the remainder of the rearward travel distance required to reach the fire (e.g. battery) position. Upon firing, the expanding propellant gases force the cartridge and piston to telescope open, accelerating the bolt rearward and cycling the weapon. A portion of the propellant gases is bled through orifices to propel the payload from the barrel. Alternatively, a second separate propellant charge may be used to launch the payload from the barrel at the desired energy level.

The operation of the 40 mm MK19 Grenade Machinegun using the cartridge of the present invention is as follows: The cartridge travels through the weapon feed mechanism. The outside configuration of the cartridge and the position of the link is preferably constrained to that of conventional ammunition in order to be compatible with the weapon. The link and cartridge are restrained during the delinking operation and cartridge pickup as the bolt reaches the battery position. As the bolt is returned rearward, the cartridge is cammed down the bolt face into alignment with the barrel. As the bolt moves forward to the battery position, the cartridge is chambered.

During chambering, the link moves relative to the base of the cartridge to allow the bolt to reach the fire position. This is accomplished by the cartridge telescoping alone or in combination with the link movement. The shoulder under the link provides the surface through which reaction loads are transmitted to the barrel. The shoulder provides the means for telescoping the cartridge to the closed position during chambering. Upon firing, the cartridge is forced to telescope open by the expanding propellant gases. Reaction loads are applied to the barrel through the shoulder and through the base of the cartridge to the bolt. The energy imparted to the bolt accelerates the bolt rearward and cycles the weapon.

The present invention enables the practical and efficient use of low impulse ammunition in an unmodified weapon such as the MK19 Grenade Machinegun. This design is enabled, at least in part, by the ability of the present cartridge to telescope closed to allow for the relative movement between the link and the base of the cartridge. Another important feature of the present cartridge is the presence of the shoulder under the link for transmitting reaction loads to the rear of the barrel.

In one embodiment, the secondary propellant charge can be used as an alternative to bleeding propellant gases from the primary propellant charge, in order to accelerate the projectile.

BRIEF DESCRIPTION OF THE DRAWINGS

The features of the present invention and the manner of attaining them will become apparent, and the invention itself will be understood by reference to the following description and the accompanying drawings. In these drawings, like numerals refer to the same or similar elements. The sizes of the different components in the figures might not be in exact proportion, and are shown for visual clarity and for the purpose of explanation.

Although the drawings illustrate a cartridge configuration with equal opening and closing telescoping stroke lengths, it should be clear that the present invention also covers cartridge configurations wherein the opening and closing stroke lengths are different. As an illustration, in the case of the MK19 Grenade Machinegun the closing stroke accommodates link movement while the opening stroke cycles the weapon, and the opening and closing strokes are not necessarily equal.

DETAILED DESCRIPTION OF THE PREFERRED EMBODIMENTS

Figure 1:
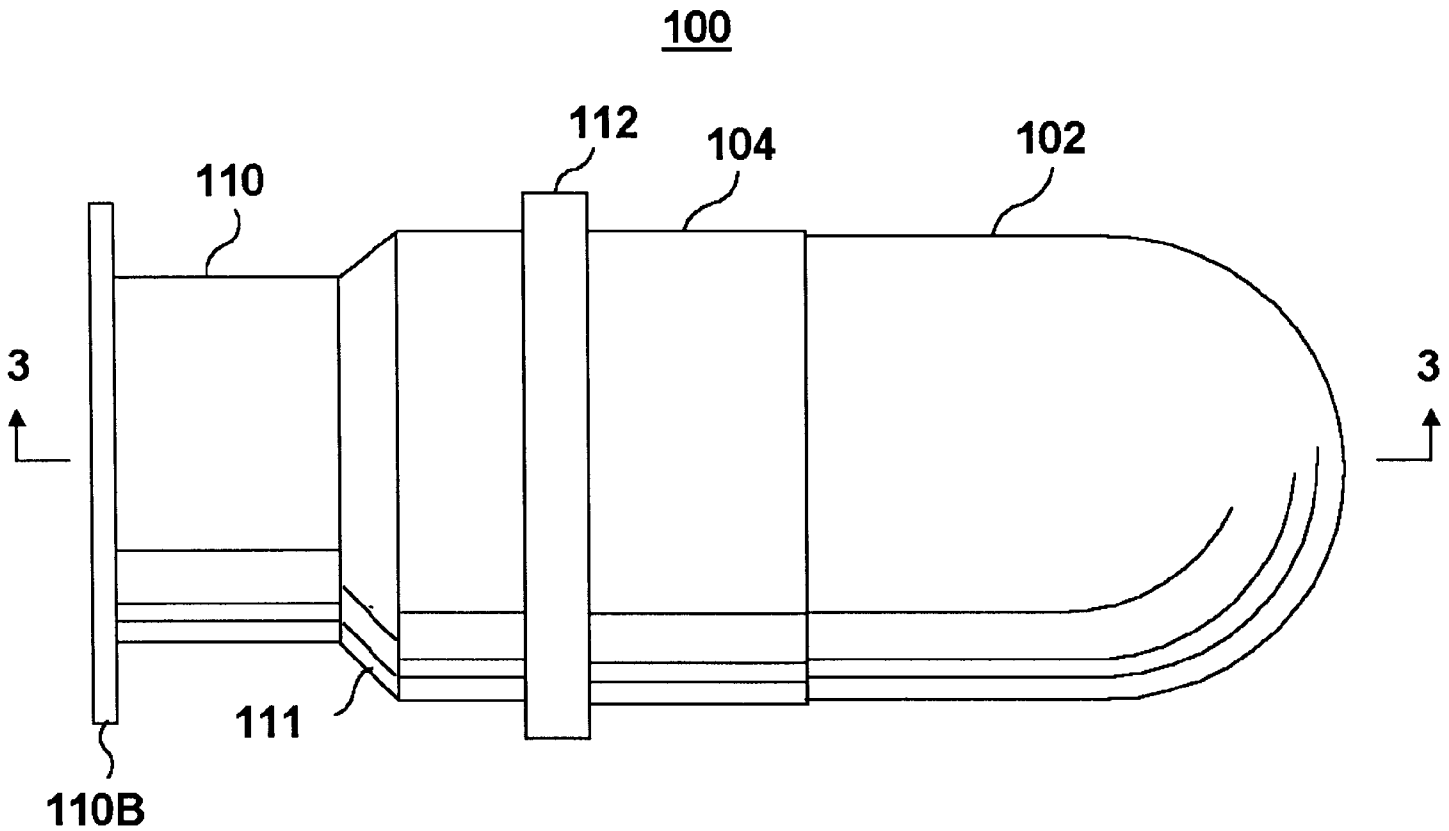
FIG. 1 is a side elevational view of a low impulse cartridge according to the present invention.
Figure 2:
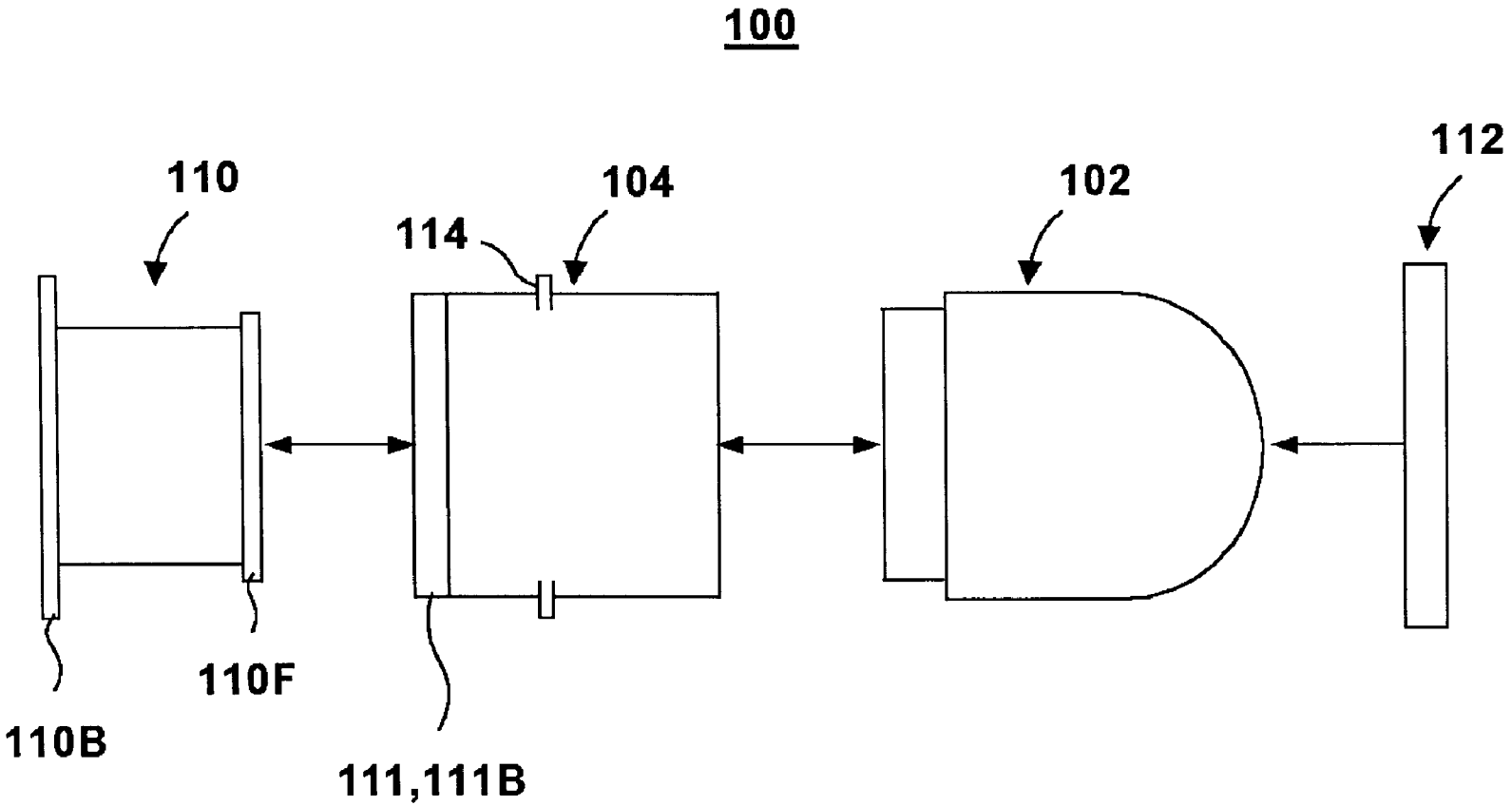
FIG. 2 is an exploded view of the cartridge of FIG. 1.
Figure 3:
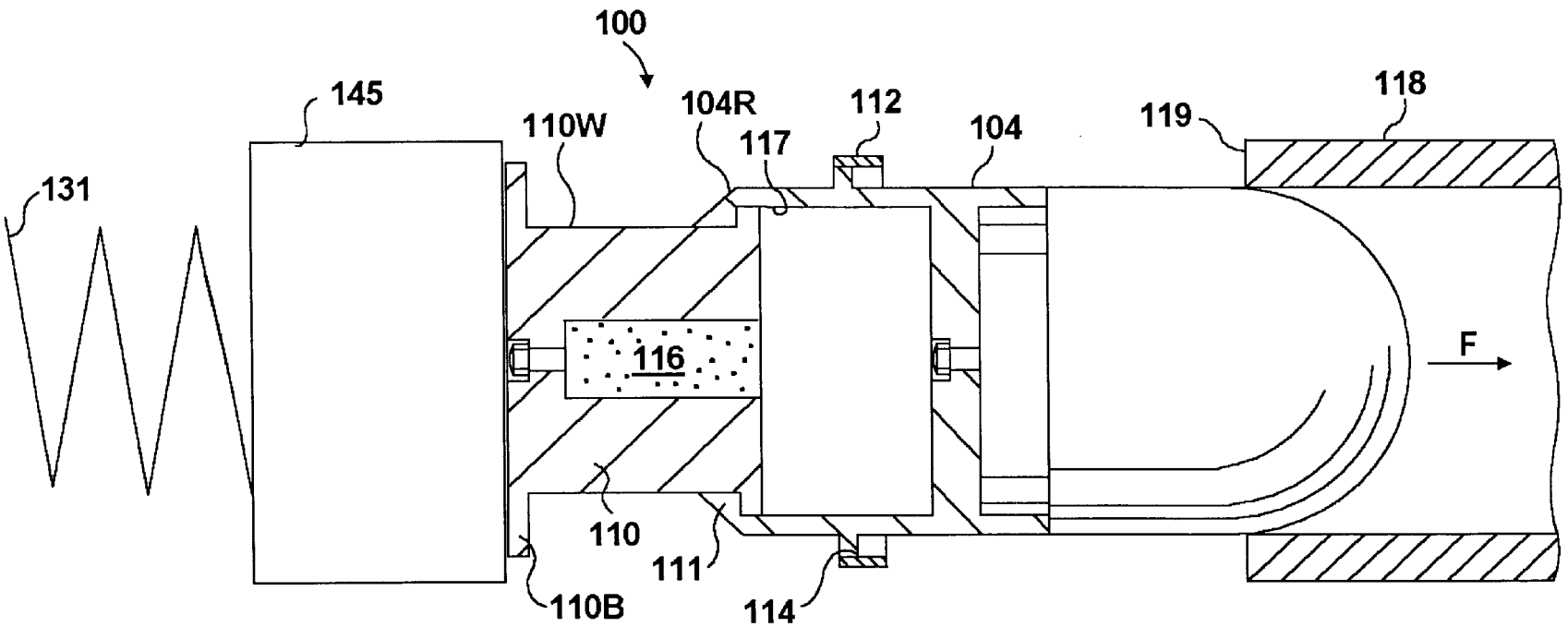
FIG. 3 is a partly cross-sectional view of the cartridge of FIG. 1 taken along line 3—3, for illustrating the feeding (or initial chambering) stage.

A low impulse, telescoping cartridge 100 according to a first embodiment of the present invention is depicted in FIGS. 1 through 8. With particular reference to FIGS. 1, 2 and 3, the cartridge 100 is generally comprised of four main components: a projectile or payload 102, a piston 104, a case 110, and a link 112.

The cartridge case 110 contains a primer 113 to provide ignition. A propellant 116 provides the required propulsion energy to function a weapon. A crimp 111 or another similar or equivalent feature secures the case 110 relative to the piston 104 in such a manner that allows for the cartridge 100 telescoping function, that prevents the case 110 from separating from the piston 104, and that further prevents cartridge telescoping during the delinking process while feeding. The overall outer configuration of the cartridge 100 matches the outer configuration of a conventional ammunition where the cartridge interfaces with the weapon, to the extent necessary for reliable weapon operation.

The cartridge case 110 fits into the rear portion 104R of the piston 104 such that a portion of the outer wall 110W of the cartridge case 110 mates with the inner wall 117 of the piston 104 to provide a seal for containing the propellant gases. The piston 104 further includes a shoulder 114 that protrudes outwardly from the periphery of the piston 104 to provide a stop for the barrel 118 when the cartridge 100 is fully chambered. The shoulder 114 limits the travel distance of the piston 104 within the barrel 118. The shoulder 114 also provides a mechanism through which the reaction forces are transmitted from the piston 104 to the rear surface or breech 119 of the barrel 118.

During firing, the expanding propelling gases force the piston 104 to telescope open so that the shoulder 114 provides the load path for reacting against the barrel 118. Simultaneously, the case 110 provides a load path to react against a bolt 115 in order to function the weapon in a fully automated mode.

The link 112 provides a means for assembling a number of cartridges 100 into a belt of ammunition. The weapon design determines in large part the permissible shape and size of the link 112. The shoulder 114 is contained within, or covered by the link 112, such that the shoulder 114 does not interfere with the weapon feeding operation. The cartridge 100 telescoping function provides the mechanism for allowing the relative movement between the link 112 and the cartridge case 110 during chambering. This relative movement can be accomplished through the cartridge case 110 and piston 104 telescoping alone, or through a combination of the cartridge 100 telescoping and the link 12 movement. While the link 112 is allowed to move, according to another embodiment the link 112 is fixed to the piston 104.

According to yet another embodiment, a collapsing cartridge case replaces the telescoping function. In still another embodiment, the telescoping open stroke (i.e., travel distance) is different from the telescoping closed stroke.

The cartridge 100 is assembled by inserting the propellant 116 and the primer 113 in the case 110. The base 111B of the piston 104 is crimped over a flange 110F of the case 110 to secure the piston 104 and the case 110 is a telescoping relationship. If a separate propellant charge is needed, additional propellant 157 (FIG. 7) is placed inside the piston 104. The projectile 102 is either inserted or fixed to the piston 104. The link 112 is assembled by sliding it over the projectile 102 and part of the piston 104. The link 112 is fitted over the shoulder 114.

Having described the general components of the cartridge 100, its operation or use will now be explained in connection with FIGS. 1, and 3–7. The use of the cartridge 100 can be separated into three general stages: feeding; chambering; and firing.

Feeding

The feeding stage is illustrated in FIGS. 1 and 3. In this stage, the cartridge 100 is in the fully extended or "telescope open" position. A drive spring 131 pushes against a bolt 145, which, in turn, pushes the cartridge 100 inside the barrel 118, in the direction of the arrow F.

In the case of the 40 mm MK19 Grenade Machinegun, during the feeding stage the cartridge 100 resists telescoping in the delinking process of the weapon operation. The interface between the piston 104 and the cartridge case 110 provides a crimp 111, adhesive or other means of preventing the case 110 and piston 104 from telescoping until the cartridge 100 is chambered.

Chambering

Figure 4:
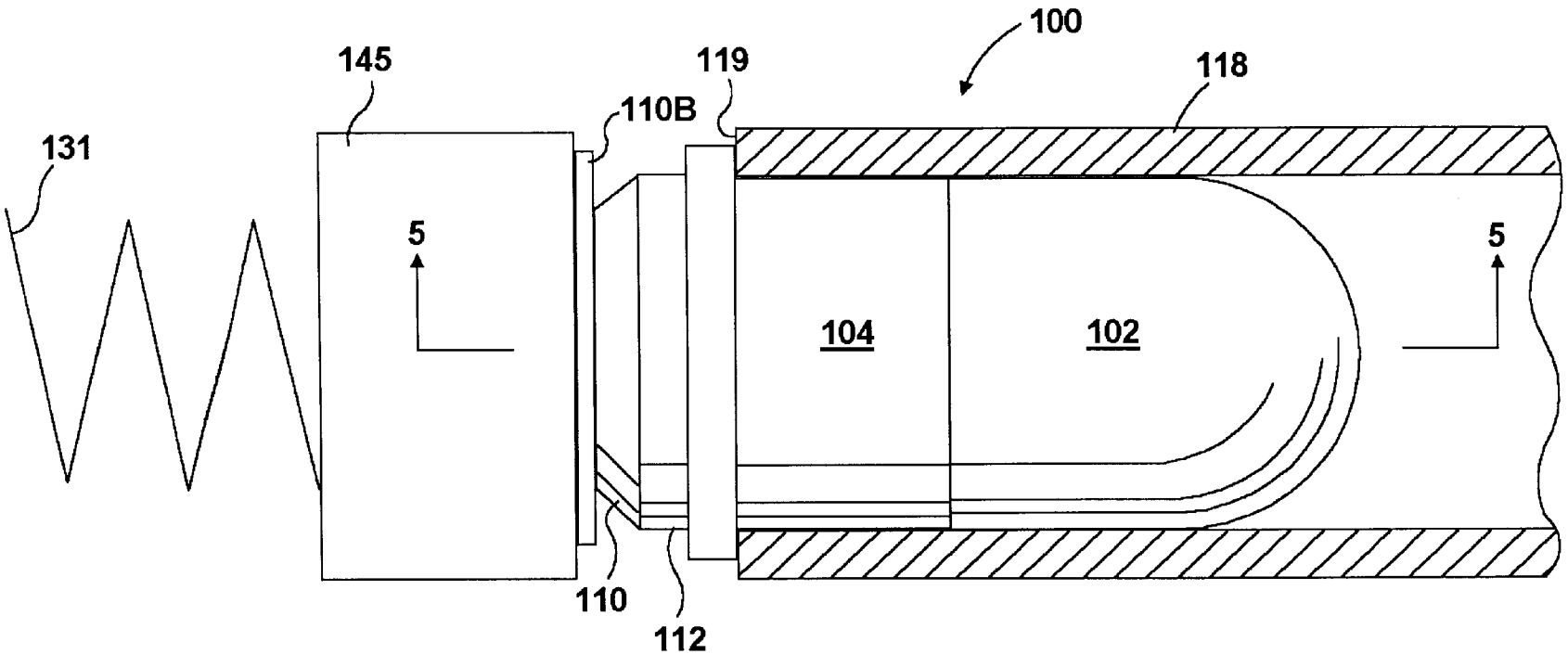
FIG. 4 is a side elevational view of the cartridge of FIGS. 1–3, shown fully chambered.
Figure 5:
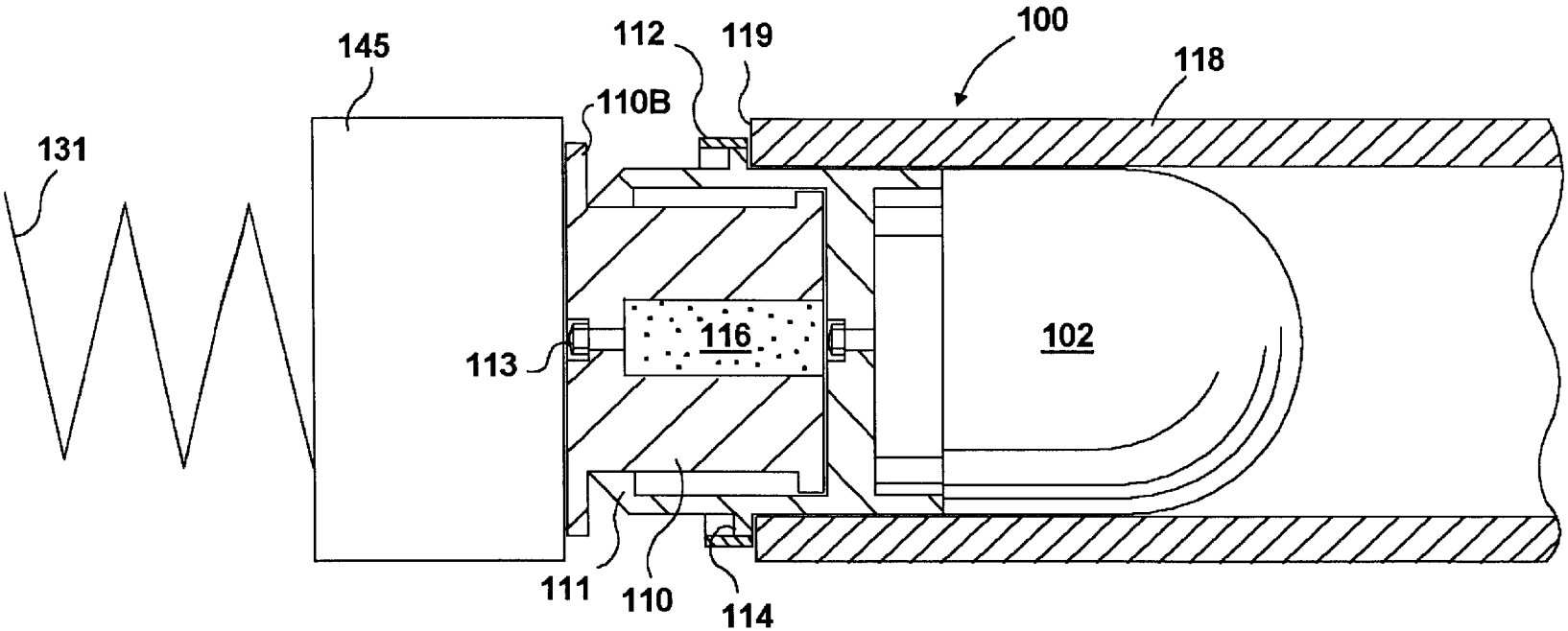
FIG. 5 is a partly cross-sectional view of the cartridge of FIG. 4 taken along line 5—5.

The chambering stage is illustrated in FIGS. 4 and 5. As the cartridge 100 is chambered, the shoulder 114 contacts the rear surface or breech 119 of the barrel 118. The resistance exerted by the crimp 111 at the interface between the piston 104 and the cartridge case 110 is overcome, and the piston 104 and the cartridge case 110 telescope to the closed (or compacted) position. The link 112 may also be allowed to move rearward toward the base 110B of the case 110 such that the combination of cartridge telescoping and link movement position the link 112 at the case (110) position required by the weapon for firing.

Firing

Figure 6:
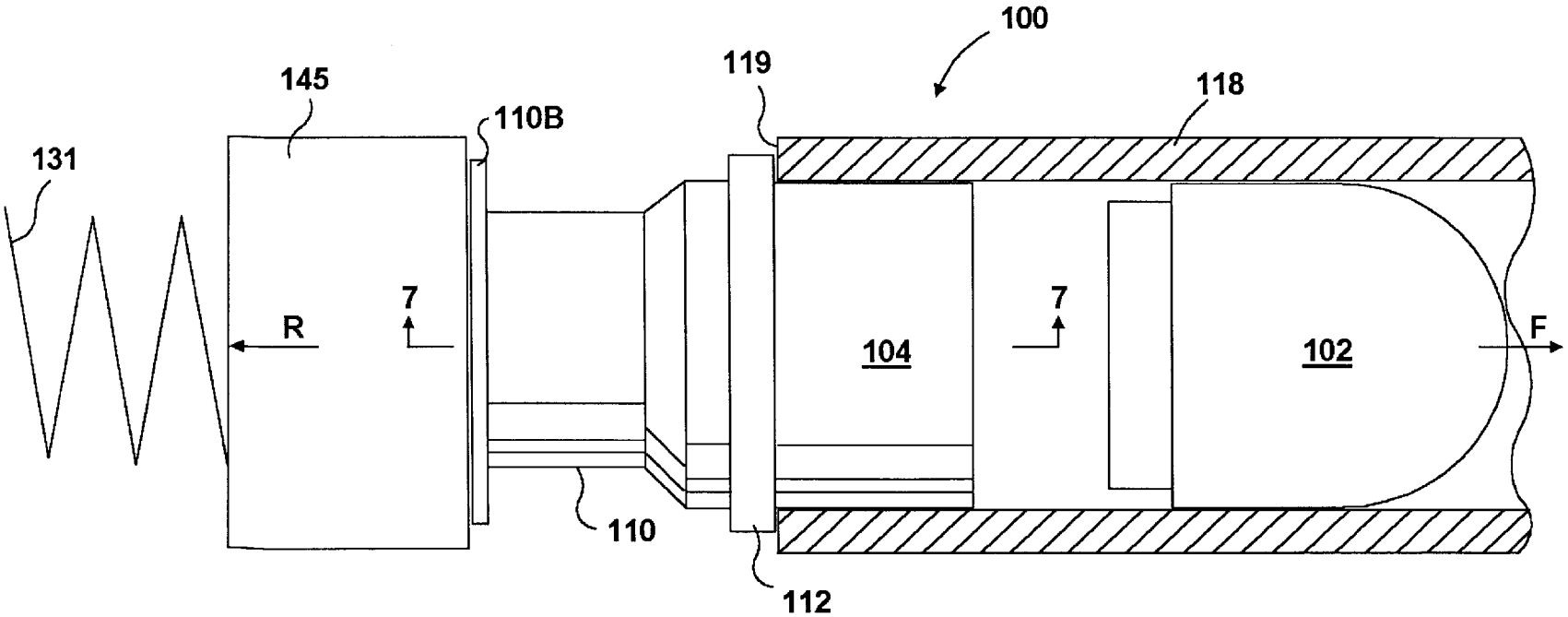
FIG. 6 is a side elevational view of the cartridge of FIGS. 4–5, shown after firing.
Figure 8:
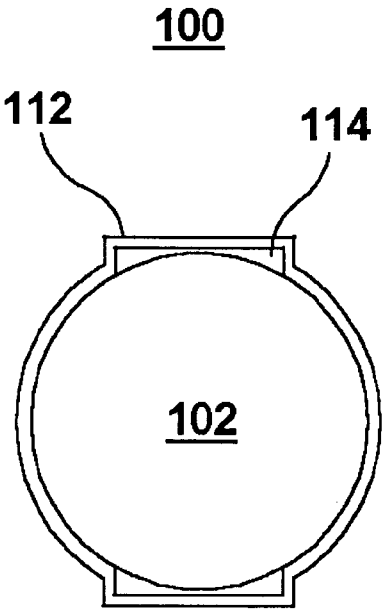
FIG. 8 is a front view of the cartridge of FIG. 1.
Figure 7:
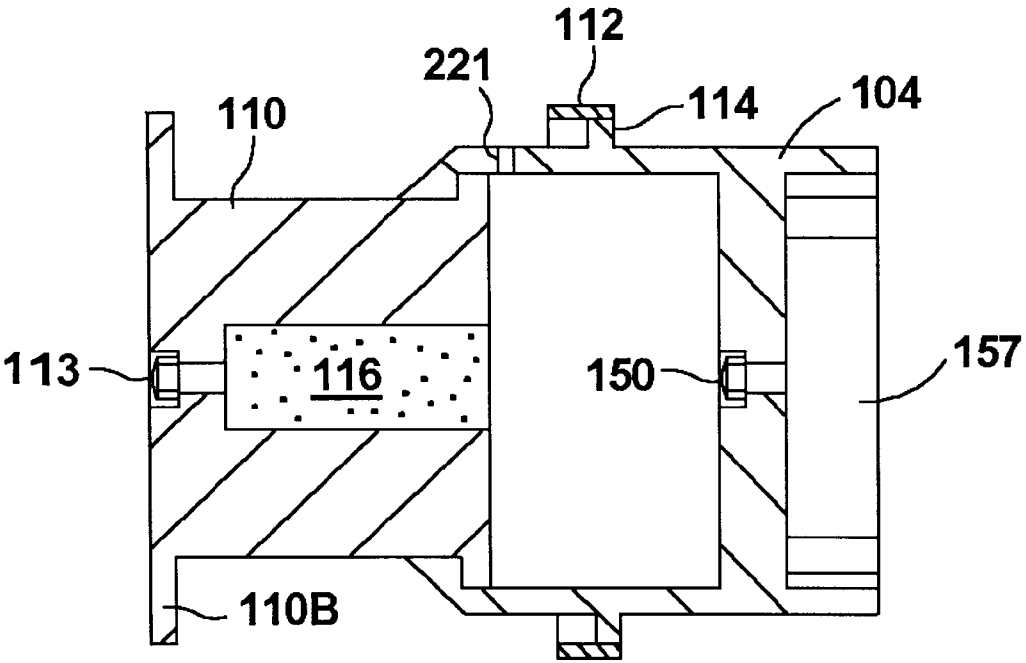
FIG. 7 is an enlarged, cross-sectional view of the case, piston, and link of the cartridge of FIG. 6 taken along line 7—7.
Figure 9:
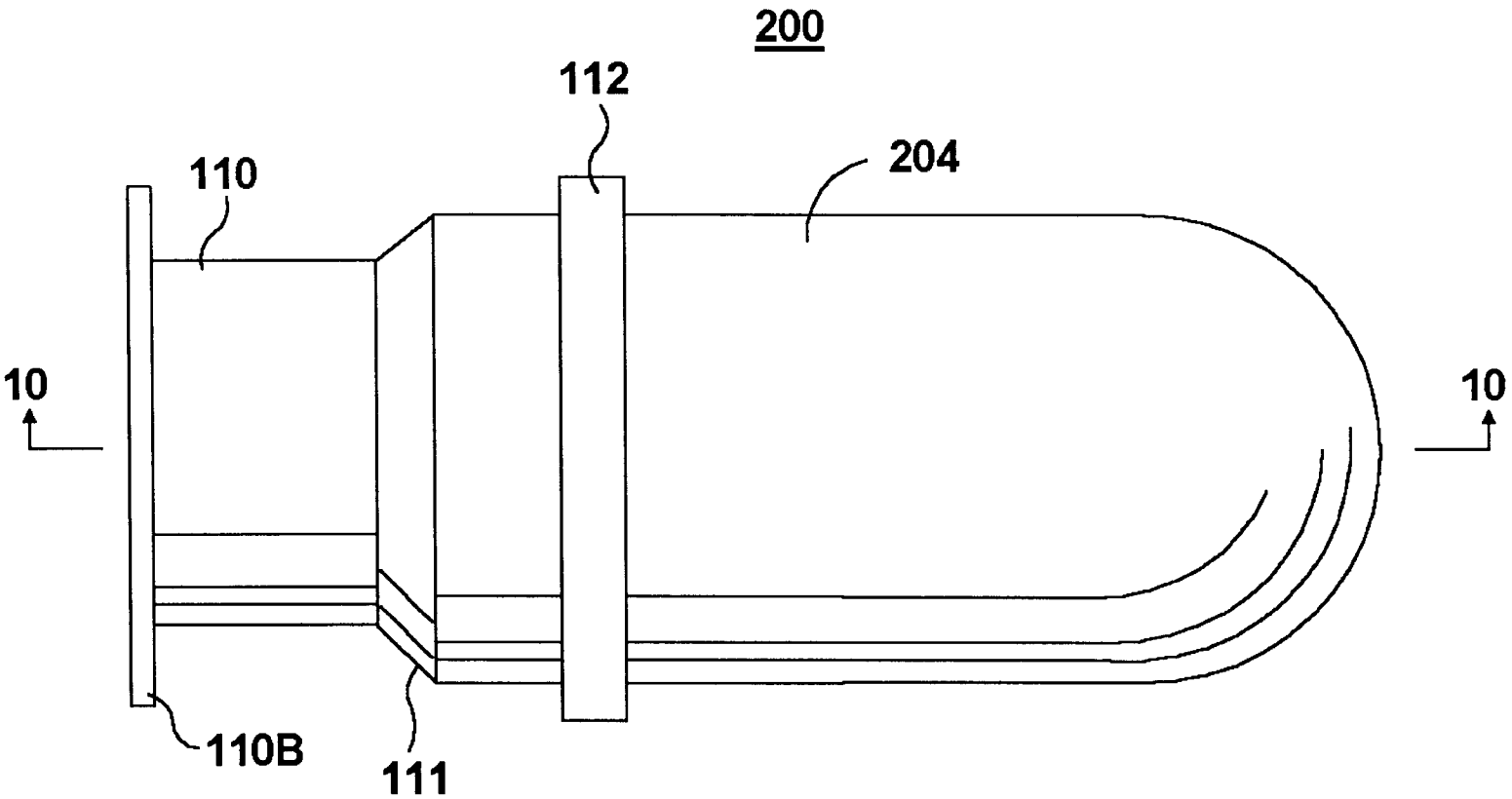
FIG. 9 is a side elevational view of a low impulse, blank cartridge according to another embodiment of the present invention.
Figure 10:
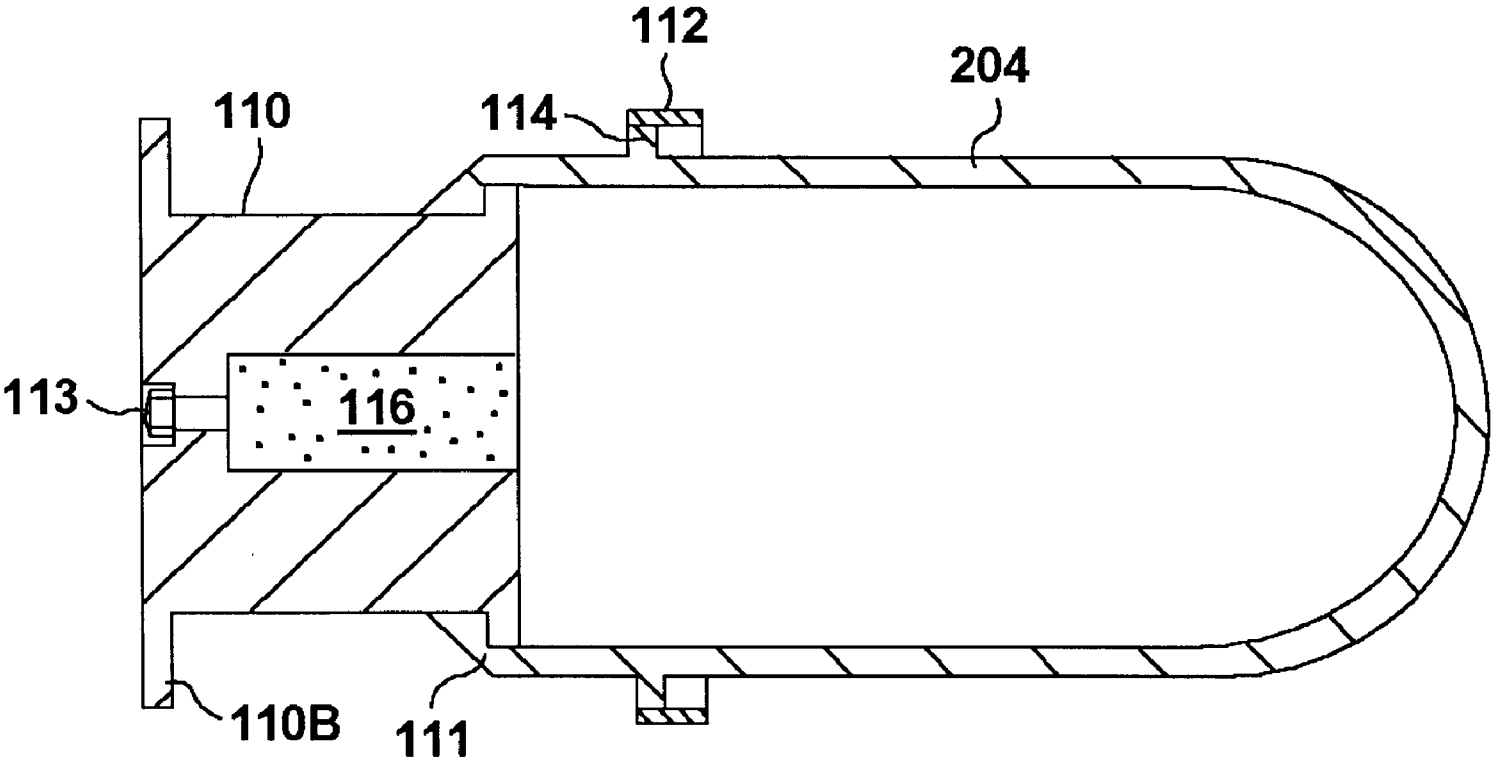
FIG. 10 is a cross-sectional view of the cartridge of FIG. 9 taken along line 10—10.
Figure 11:
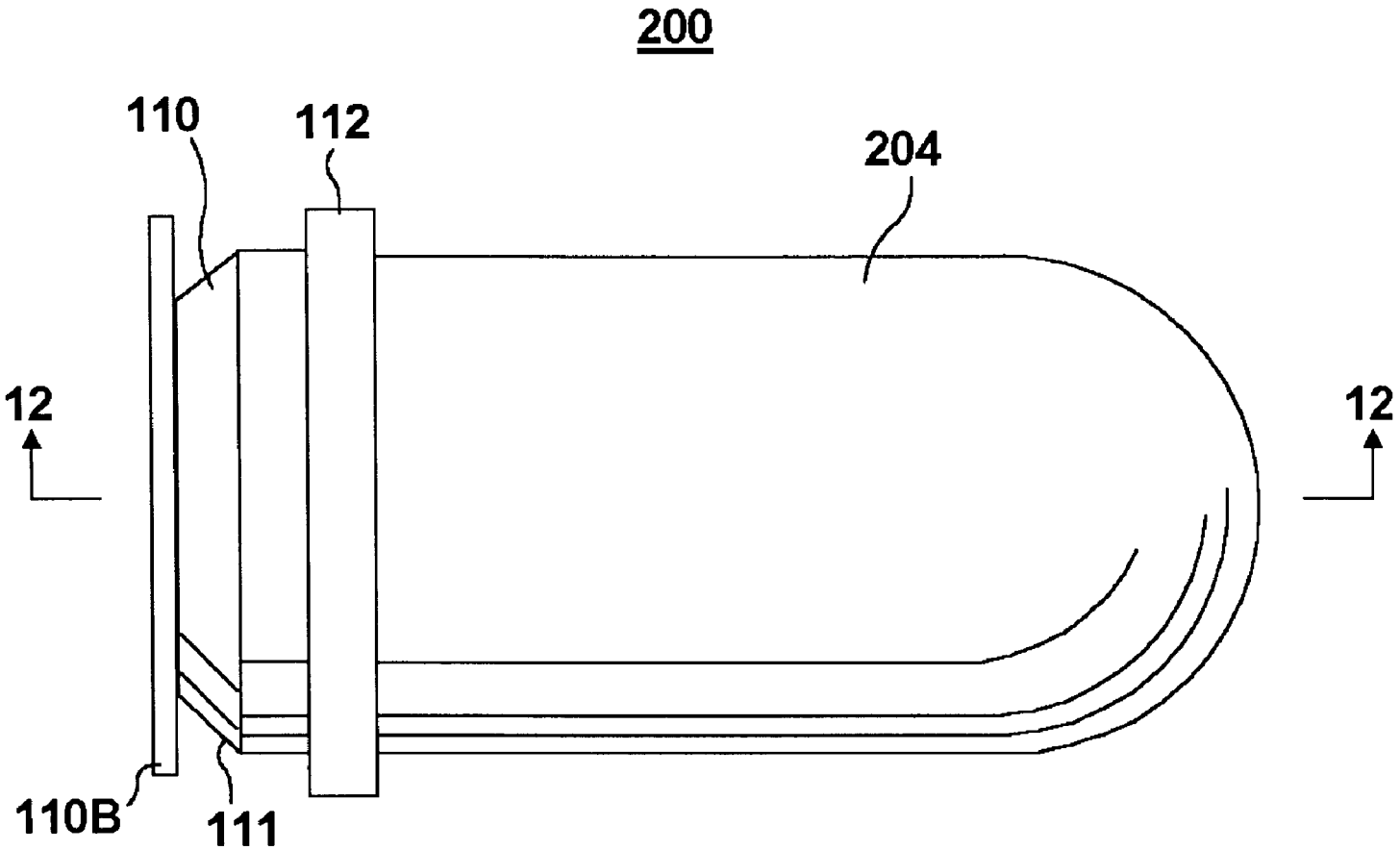
FIG. 11 is a side elevational view of the cartridge of FIGS. 9–10, shown fully chambered.
Figure 12:
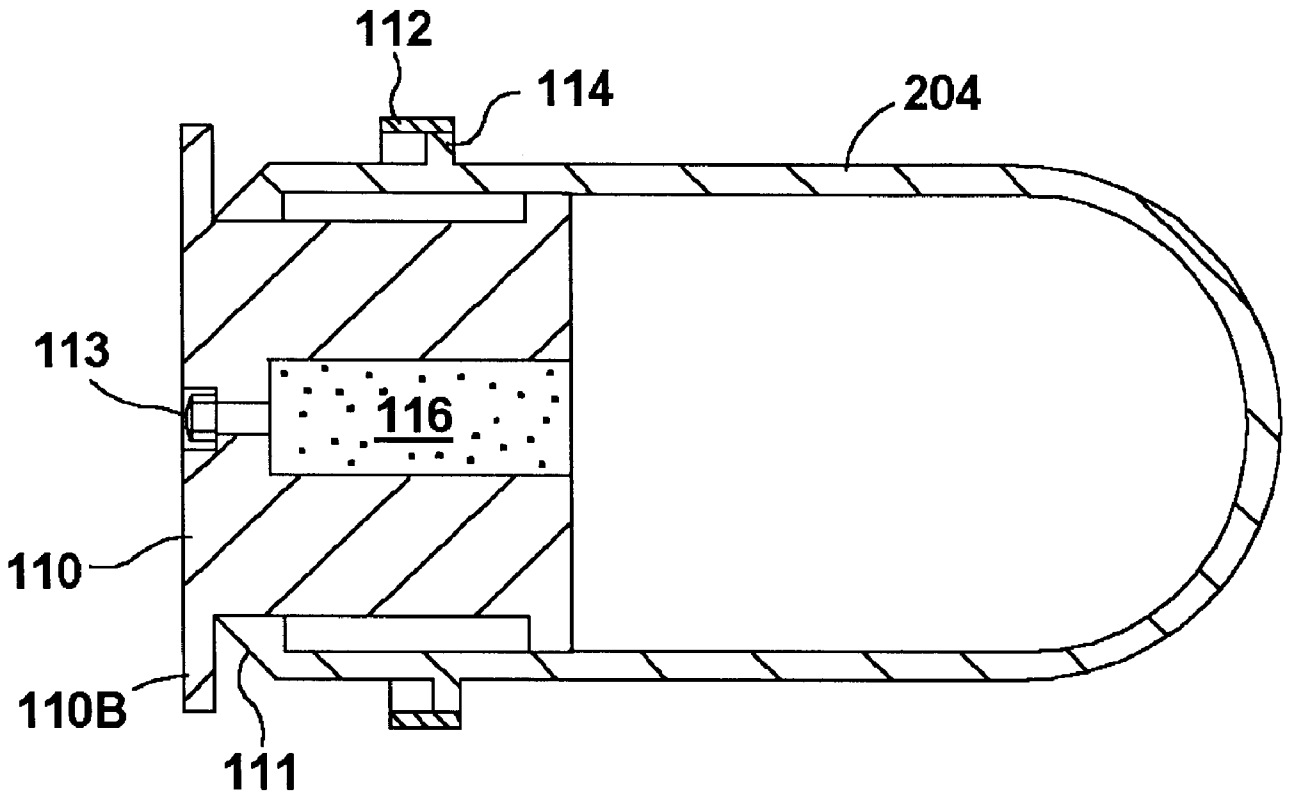
FIG. 12 is a cross-sectional view of the cartridge of FIG. 11.
Figure 13:
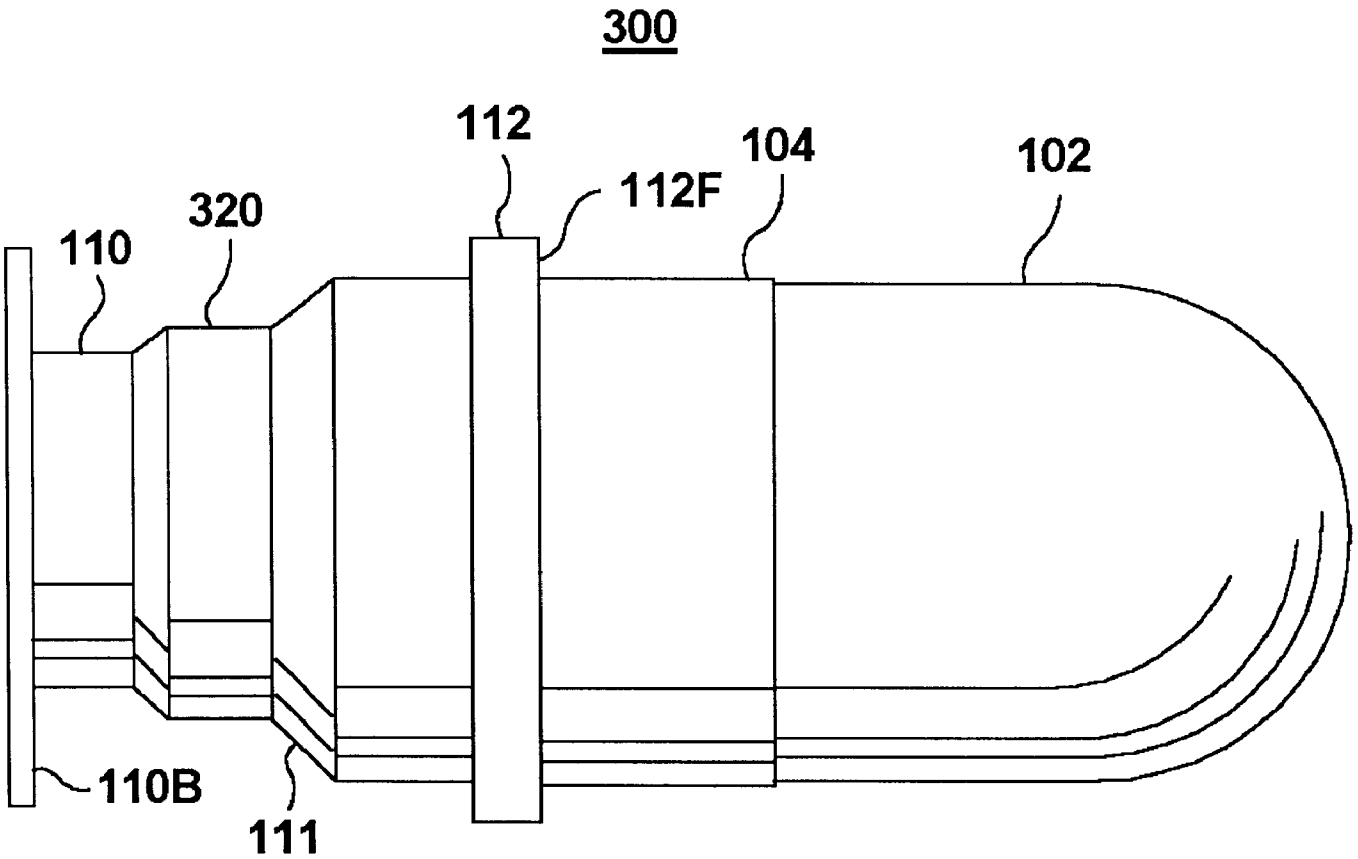
FIG. 13 is a side elevational view of a low impulse, cartridge according to yet another embodiment of the present invention, illustrating the use of three telescoping components.
Figure 14:
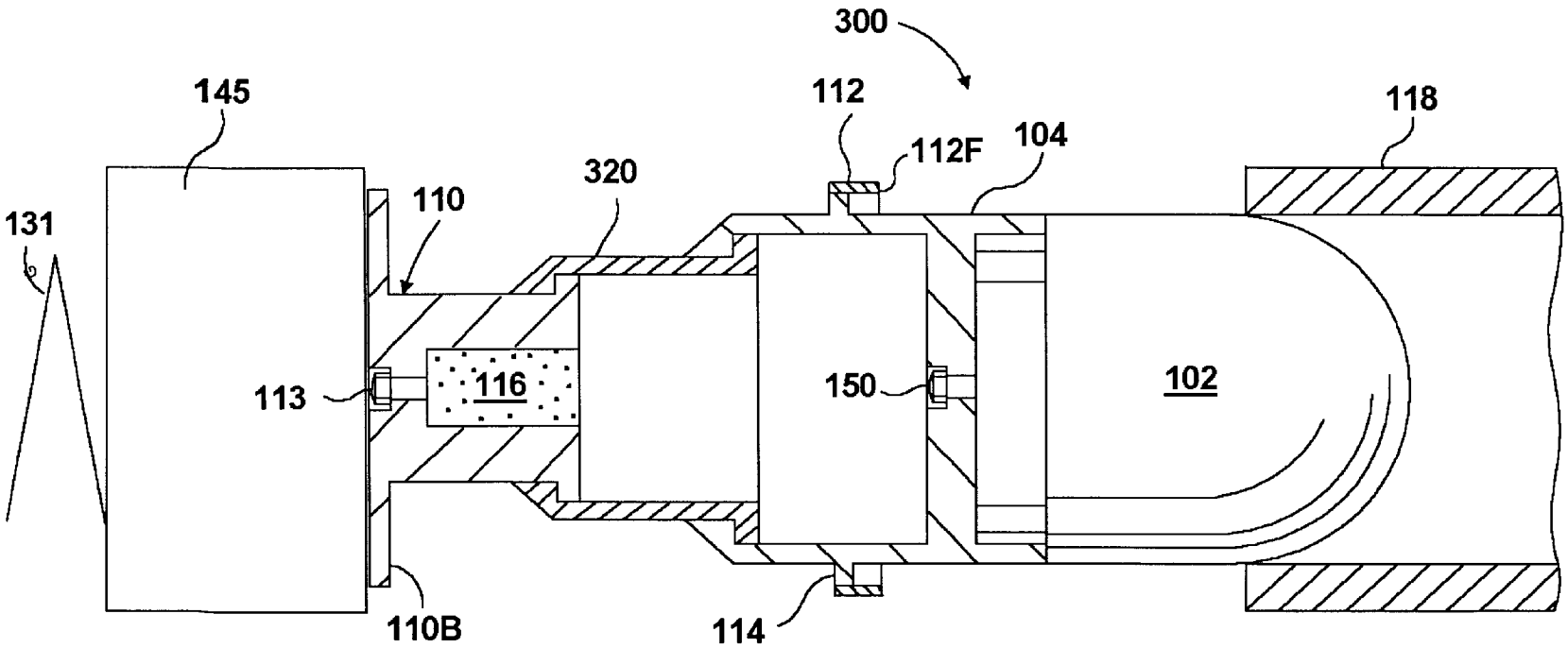
FIG. 14 is a cross-sectional view of the cartridge of FIG. 13 taken along line 14—14.
Figure 15:
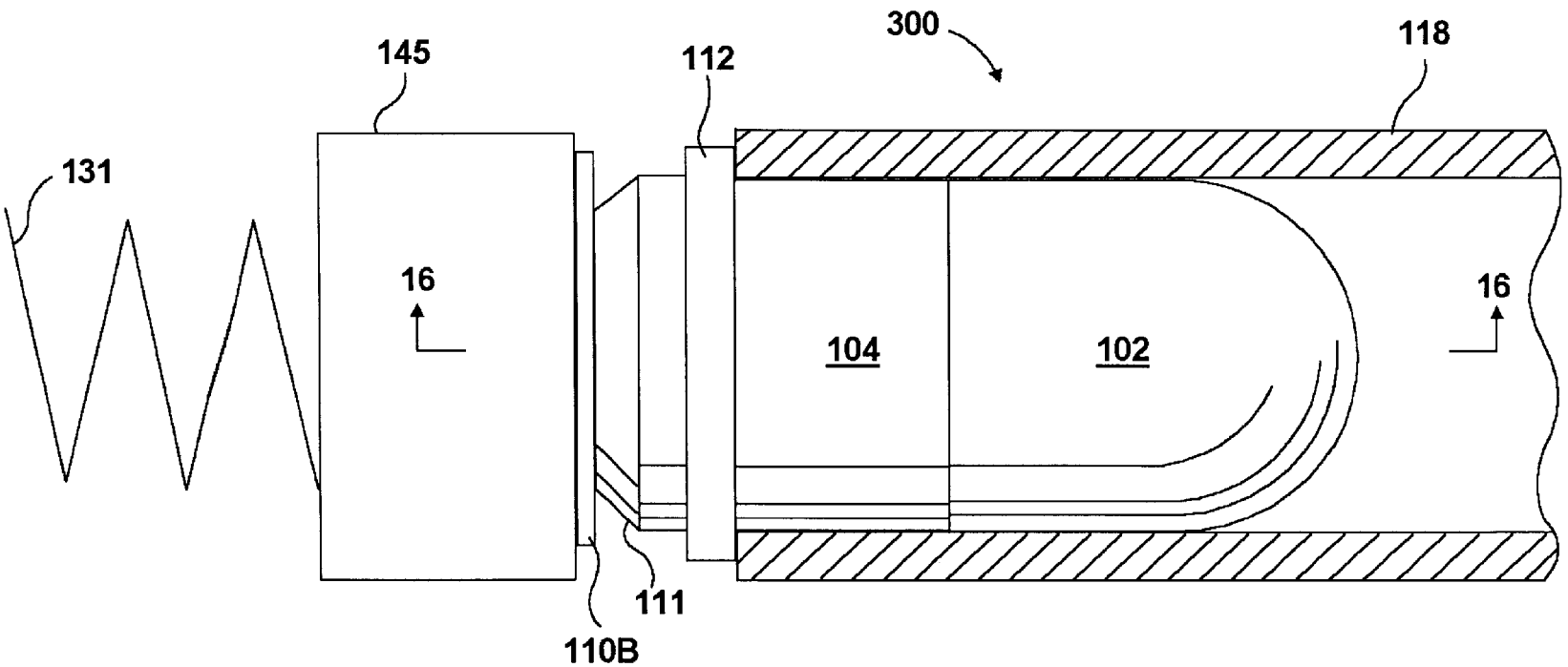
FIG. 15 is a side elevational view of the cartridge of FIGS. 12–13, shown fully chambered.

The firing stage is illustrated in FIGS. 6 and 7. Upon ignition of the primer 113, the propellant 116 ignites and pressurizes the cartridge 100. The shoulder 114 is restrained by the breech 119 of the barrel 118. The expanding propellant gases force the cartridge case 110 rearward in the direction of the arrow R. This, in turn, accelerates the bolt 145 to the rear and compresses the drive spring 131 for cycling the weapon. Propellant gases bled through to the base of the projectile 102 or a forward propellant charge 157 ignited directly or through a forward primer 150 by the hot, high pressure propellant gases from the primary propelling charge 116 cause the projectile 102 to be separated from piston 104 and to be accelerated along the barrel 118 in the direction of the arrow F. Alternatively, no projectile may be used such as with a blank cartridge where the gases are vented down the barrel 118 or within the weapon.

The case 110 is displaced rearward in the direction of the arrow R, until the cartridge 100 telescopes to the fully open position. Provisions may be made to allow venting of the gas pressure through vents 221 in the piston 104 as the cartridge 100 telescopes to the fully open position so that the crimp 111 (or other mechanism) used to secure the case 110 to the piston 104 can be minimized. The bolt 145 continues traveling rearwardly, extracting and ejecting the cartridge 100 from the weapon in the same manner as a conventional cartridge case.

With reference to FIGS. 9–12, they illustrate a low impulse blank cartridge 200 according to another embodiment of the present invention. The cartridge 200 is similar in function, construction and design to the cartridge 100 of FIGS. 1–8, with the exception that the piston 104 and the projectile 102 are secured together as a unitary piston 204. The projectile is not launched from the barrel 118 on firing. Rather, it remains attached to the case 110 and is ejected from the weapon with the case 110 when the weapon is fired.

Figure 16:
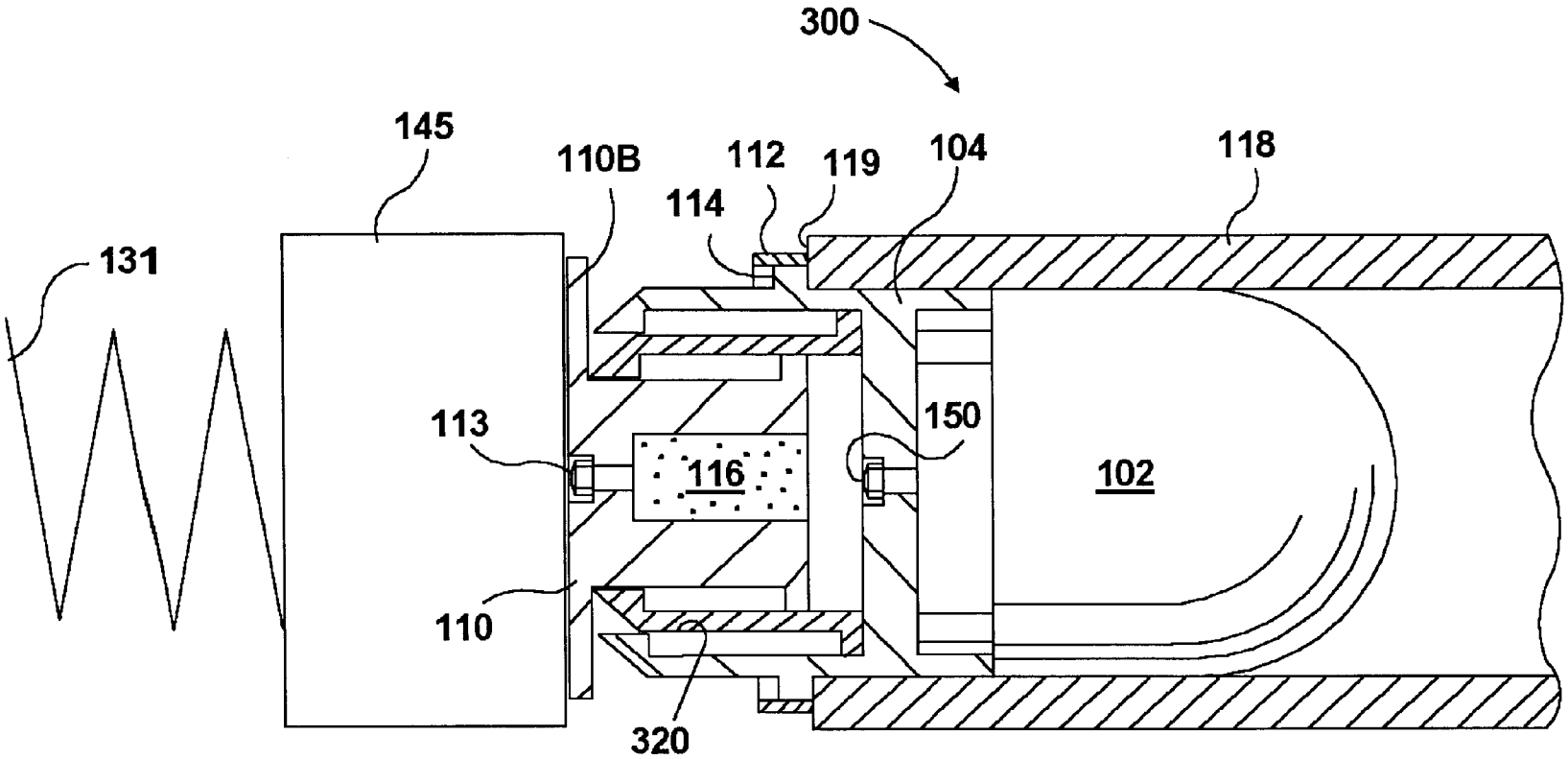
FIG. 16 is a cross-sectional view of the cartridge of FIG. 15.
Figure 17:
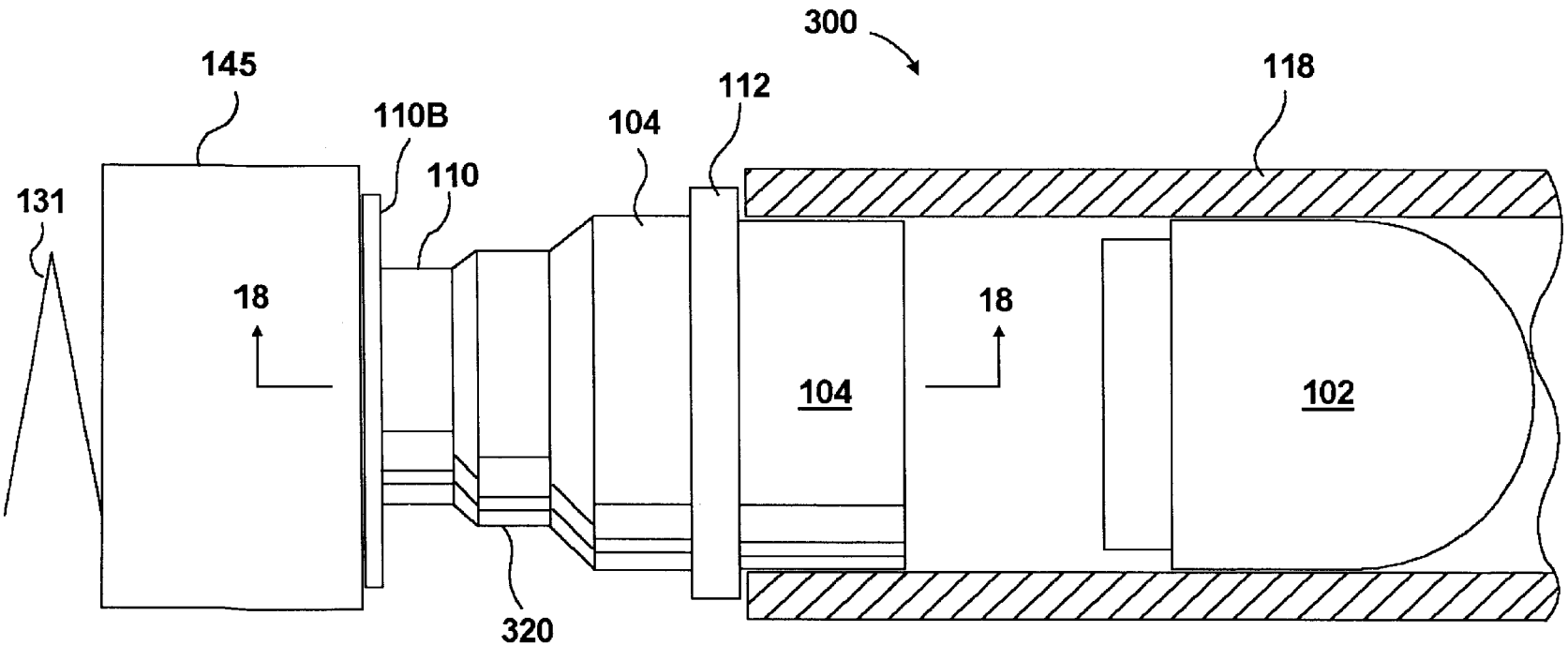
FIG. 17 is a side elevational view of the cartridge of FIGS. 13–16, shown after firing.
Figure 18:
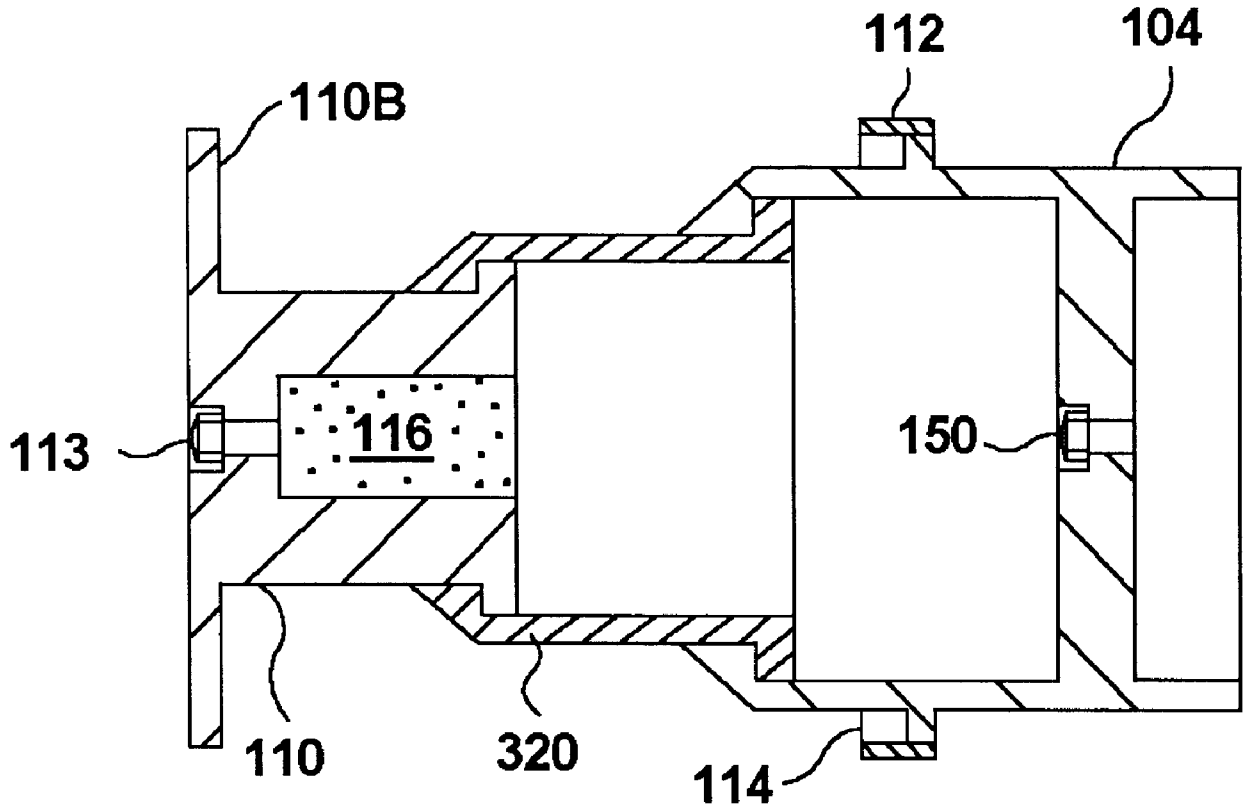
FIG. 18 is a cross-sectional view of the case, piston, and link of the cartridge of FIG. 17 taken along line 18—18.

FIGS. 13–18 illustrate another low impulse cartridge 300 according to the present invention for use with specific weapons such as the 40 millimeter MK19 Grenade Machinegun. For the latter application, provisions must be made to allow the link 112 to move from the original unfired position (FIG. 14) to the fired position (FIG. 16). As a result, the forward edge 112F of the link 112 moves from a position approximately 2.50 inches from the base 110B of the case 110 before firing (FIG. 14) to a position approximately 1.125 inches from the base 110B of the case 110 upon firing. In order to achieve a 50 percent reduction in length between the forward edge 112F of the link 112 and the base 110B of the case 110 while allowing overlap of parts for retention proposes, a minimum of three telescoping components are required or one or more components must deform due to space constraints. Using the link 112 as one of the telescoping components reduces the total number of components required.

The cartridge 300 is generally similar in design, function, and construction to the cartridges 100 and 200 described above. However, the cartridge 300 includes one or more additional telescoping arm 320 which is disposed intermediate the piston 104 and the case 110. In the feeding position (FIGS. 13, 14), the telescoping arm 320 is in the fully extended open position. In the chambering position (FIGS. 15, 16), the telescoping arm 320 is in the fully retracted or telescope closed position. After firing (FIGS. 17, 18), the telescoping arm 320 returns to the fully extended open position.

It should be understood that the geometry and dimensions of the components described herein may be modified within the scope of the invention and are not intended to be the exclusive; rather, they can be modified within the scope of the invention. Other modifications may be made when implementing the invention for a particular application. For example, while the cartridges 100, 200, 300 described herein provide for a link 112 movement that supplements the case 110 telescoping feature, it is possible to eliminate such link 112 movement relative to the piston 104. All of the above cartridges 100, 200, 300 can be used in conventional blowback operated 40 mm Grenade Machineguns and other caliber weapons with little or no modification to the weapon.

What is claimed is:

1. A low impulse cartridge for use in a weapon including a barrel, the cartridge comprising:

a case;

a piston slidably disposed relative to said cartridge case;

a shoulder protruding outwardly from a periphery of said piston to provide a stop surface for the barrel when the cartridge is chambered;

wherein said piston is in a normally telescoping open position;

wherein and said piston telescopes in a closed position during chambering whereupon the barrel is forced against the shoulder, so that said shoulder provides a load path for reacting against the barrel; and wherein said piston telescopes in said open position after firing.

2. A cartridge according to claim 1, further including a link that enables the linking of a plurality of cartridges into a belt of ammunition.

3. A cartridge according to claim 2, wherein said link is positioned over said shoulder.

4. A cartridge according to claim 3, wherein said link slidably translates rearwardly over said shoulder upon impact with the barrel.

5. A cartridge according to claim 3, wherein said link is affixed to said piston.

6. A cartridge according to claim 1, wherein a telescoping open stroke is different from a telescoping closed stroke.

7. A cartridge according to claim 1, wherein a telescoping open stroke is the same as a telescoping closed stroke.

8. A cartridge according to claim 1, further including a payload to be projected upon firing.

9. A cartridge according to claim 8, wherein said payload includes a projectile.

10. A cartridge according to claim 8, wherein said payload includes any one or more of: a rubber ball, a bean bag, a foam baton, a wood baton, a sponge grenade, a flash bang projectile, a limited range training projectile, or a training projectile.

11. A cartridge according to claim 8, wherein said projectile is affixed to said piston.

12. A cartridge according to claim 1, further including a telescoping arm disposed intermediate said piston and said case.

13. A cartridge according to claim 1, wherein said telescoping arm is in a normally open position.

14. A cartridge according to claim 13, wherein said telescoping arm is retracted in a closed position during chambering.

15. A cartridge according to claim 14, wherein said telescoping arm returns to said open position upon firing.

* * * * *